United States Patent [19]

Terhune

[11] Patent Number: 4,967,731

[45] Date of Patent: Nov. 6, 1990

[54] DEVICE AND METHOD FOR LIGHTING A FIRE IN A FIREPLACE

[76] Inventor: Diane D. Terhune, Runnymead Rd., Essex Fells, N.J. 07021

[21] Appl. No.: 333,420

[22] Filed: Apr. 4, 1989

Related U.S. Application Data

[63] Continuation-in-part of Ser. No. 160,120, Feb. 25, 1988, abandoned.

[51] Int. Cl.[5] ..... F24B 1/192

[52] U.S. Cl. ..... 126/544; 126/521; 126/547

[58] Field of Search ..... 126/544, 547, 548, 500, 126/545; 160/DIG. 9; 16/DIG. 11

[56] References Cited

U.S. PATENT DOCUMENTS

| | | | |
|---|---|---|---|
| 328,342 | 10/1885 | Robinson | 126/544 |
| 494,046 | 3/1893 | Vance | 126/546 |
| 624,984 | 5/1899 | Scanlan | 126/547 |
| 1,590,396 | 6/1926 | Sutton | 126/547 |
| 1,606,112 | 11/1926 | Sutton | 126/547 |
| 1,759,619 | 5/1930 | Hutchinson | 126/544 |
| 1,830,364 | 11/1931 | Knudson | 126/547 |
| 1,881,333 | 10/1932 | Steiner | 126/547 |
| 2,077,324 | 4/1937 | Horner | 126/547 |
| 2,294,046 | 8/1942 | Cser | 126/548 |
| 2,501,278 | 3/1950 | Hughes | 126/548 |
| 2,616,499 | 11/1952 | Eckles | 126/551 |
| 2,887,154 | 5/1959 | Morningstar et al. | 126/547 |
| 3,789,825 | 2/1974 | Reiner | 126/547 |
| 3,888,232 | 6/1975 | LeBrun | 126/547 |
| 3,894,527 | 7/1975 | Ickes | 126/545 |
| 4,010,730 | 3/1977 | Mitchell | 126/547 |
| 4,072,140 | 2/1978 | Gallagher | 126/547 |
| 4,108,145 | 8/1978 | Klomser | 126/545 |
| 4,160,442 | 7/1979 | Fox | 126/547 |
| 4,202,396 | 5/1980 | Levy | 160/107 |
| 4,294,224 | 10/1981 | Luther | 126/546 |
| 4,508,098 | 4/1985 | Scheler | 126/545 |
| 4,603,682 | 8/1986 | Maziasz | 126/500 |
| 4,611,572 | 9/1986 | Martenson | 126/77 |

FOREIGN PATENT DOCUMENTS

| | | | |
|---|---|---|---|
| 9458 | of 1908 | United Kingdom | 126/521 |
| 15052 | of 1910 | United Kingdom | 126/521 |
| 378658 | 8/1932 | United Kingdom | 126/521 |

*Primary Examiner*—James C. Yeung

*Attorney, Agent, or Firm*—Ratner & Prestia

[57] ABSTRACT

A flat cover formed of a fire resistant material is provided for use when igniting objects in a fireplace. The cover has an access and air opening which is disposed on the cover so that when the cover is positioned over the fireplace opening, the access and air opening is near the hearth area to permit access to the objects through the access and air opening while obstructing air flow into the fireplace except in the hearth region. The cover is rigid and may be formed of hingedly connected panels to permit folding and storage of the cover.

9 Claims, 2 Drawing Sheets

DEVICE AND METHOD FOR LIGHTING A FIRE IN A FIREPLACE

This is a continuation-in-part of U.S. patent application Ser. No. 160,120 filed Feb. 25, 1988, abandoned.

BACKGROUND OF THE INVENTION

1. Field of the Invention

This invention relates to fireplace cover and in particular to a temporary fireplace cover.

2. Background Art

When first lighting a fire in a fireplace while the chimney is cold, a down draft often causes smoke and gas to back up into the room in which the fireplaces is located. This may cause costly damage to the interior of the room, force the user to open doors and windows to clear out the smoke, wasting heat and causing a health hazard in cold weather, and otherwise creating odors, eye irritation and miscellaneous side effects.

Additionally, when lighting a fire it is useful to have air directed against the objects being ignited. This causes them to catch fire more quickly and more evenly and helps prevent the fire from going out before it is well lit and a good up draft is started.

Many fireplace closure devices are known in the art. For example, fireplace closure devices are taught in:

| U.S. Pat. No. | Inventor |
|---|---|
| 4,072,140 | Gallagher |
| 1,590,396 | Sutton |
| 1,606,112 | Sutton |
| 624,984 | Scanlan |
| 4,108,145 | Klomser |
| 3,789,825 | Reiner |
| 3,888,232 | LeBrun |
| 4,010,730 | Mitchell |
| 4,170,442 | Fox |

All of the fireplace closure devices taught in these patents may be placed over a fireplace opening to block the opening. However, they are adapted to merely prevent heat loss from a room by way of a fireplace opening. They are cumbersome to install and remove and are not adapted for temporary use while a fire is being lit.

Many screens are known in the art for use while fire is burning. For example:

| U.S. Pat. No. | Inventor |
|---|---|
| 1,830,364 | Knudson |
| 2,294,406 | Cser |
| 2,501,278 | Hughes |
| 2,616,499 | Eckles |
| 4,294,224 | Luther |

All of these screens permit air to flow into the fireplace opening during lighting and permit development of an up draft. However, none of these screens prevent down draft during lighting because they do not obstruct air flow. Additionally, air which enters the fireplace opening during use of these screens may enter any region of the fireplace opening and is not directed against the objects being lit to facilitate their ignition. Furthermore, none of these screens permit access to the objects being lit while they are in position. Access while lighting a fire is useful because it permits the user to reach into the hearth area and perform the operations necessary to assist in ignition and to prevent the fire from going out before it is completely lit.

Some screens, for example the screen taught in U.S. Pat. No. 1,759,619 issued to Hutchinson, permit access to the hearth region of the fireplace where the objects to be lit are positioned and allow the user to work on the objects being lit. However, Hutchinson does not direct the influx of air into the fireplace against the objects to be lit and does not protect a user against down draft.

By virtue of the examination of the parent of the present application, applicant has become aware of the following additional references, namely U.S. Pat. No. 3,789,825 Reiner, U.S. Pat. No. 3,894,527 Ickes, U.S. Pat. No. 4,508,098 Scheler, U.S. Pat. No. 1,881,333 Steiner, and U.K. Patent Nos. 9,458 378,658 and 15,052. U.K. Patent No. 378,658 is of particular interest for its showing of a temporary fireplace covering with an opening which begins at the base of the hearth but extends in long narrow vertical opening.

SUMMARY OF THE INVENTION

A flat temporary cover formed of a fire resistant material is provided for use when igniting objects in the hearth region of a fireplace. The cover has an access and air opening which is disposed on the cover so that when the cover is positioned over the fireplace opening, the access and air opening is near the hearth area to permit access to the objects while obstructing air flow into the fireplace except in the hearth region.

More specifically, the temporary fireplace enclosure of this invention includes an opening, the top of which is below the top level of the objects to be ignited ("the ignition material") and preferably no higher than about one half the vertical distance from the hearth floor to the top of the ignition material. Secondly, the opening should be substantially horizontal, that is it should have a length to height ratio of at least 2, and preferably 3 or more.

DETAILED DESCRIPTION OF THE INVENTION

Figure 1:
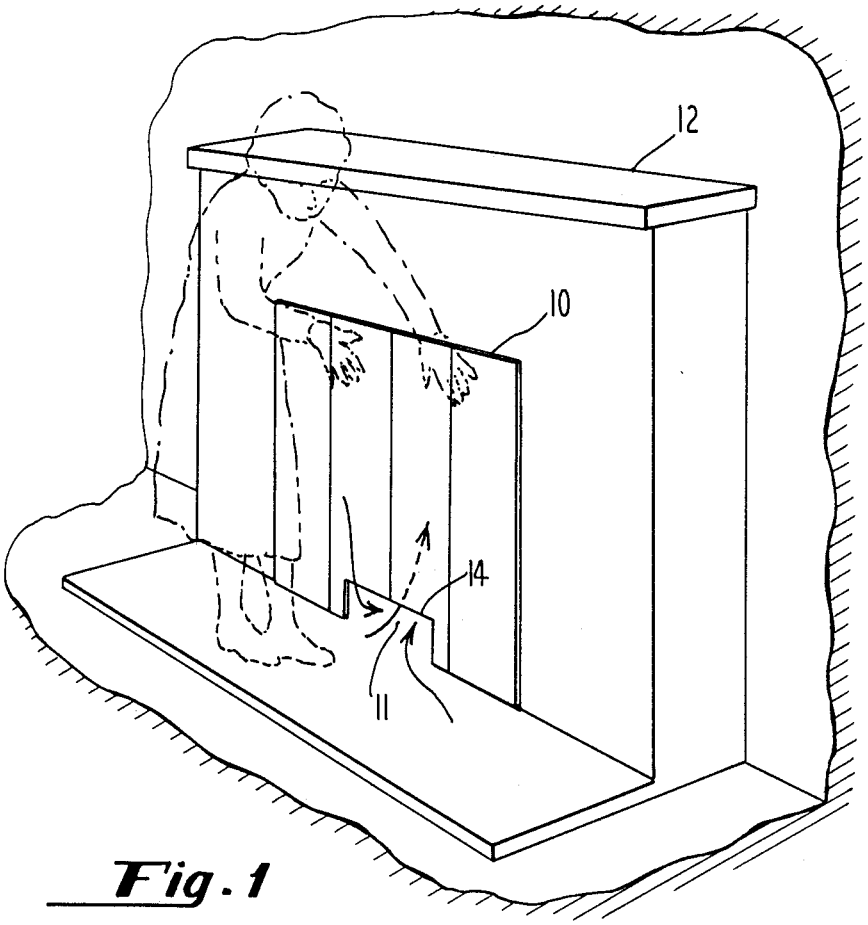
FIG. 1 is a perspective view showing the device for lighting a fire in a fireplace of the present invention positioned over a fireplace opening.
Figure 2:
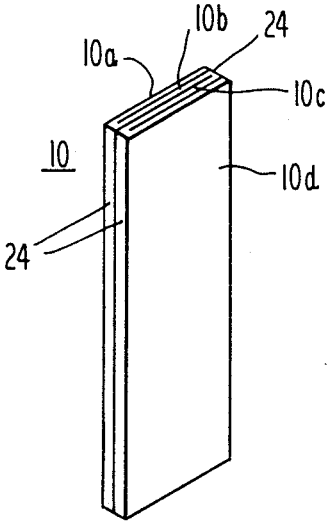
FIG. 2 shows the device of FIG. 1 in a folded position.

Referring now to FIGS. 1–4, there is shown fireplace cover 10 for lighting a fire in a fireplace 12. Cover 10 is a fireplace closure device which is provided with an access and air opening 14 for obstructing air flow into opening 26 of fireplace 12 except in hearth region 11 where objects 20 to be lit are placed. When cover 10 is positioned over fireplace opening 26 during or just after lighting of objects 20, cover 10 provides protection against ashes and smoke during a down draft by substantially preventing ashes and smoke from leaving opening 26 of fireplace 12 and entering the room in which fireplace 12 is located.

In addition to blocking down drafts from fireplace opening 26 access and air opening 14 of cover 10 also provides access to hearth region 11 when cover 10 is in place over fireplace opening 26. Thus a user may reach through access and air opening 14 to manipulate objects 20 or further ignite objects 20. A user may also add additional objects 20 to hearth region 11 through access and air opening 14.

As objects 20 start burning air is drawn into fireplace opening 26. Cover 10 with access and air opening 14 prevents air from being drawn into fireplace opening 26 at any region of fireplace opening 26 except at hearth region 11. Thus all air flow into fireplace opening 26 is directed against objects 20 further assisting in their ignition.

Cover 10 is formed of a rigid material and may be temporarily positioned over fireplace opening 26, resting on the floor immediately in front of opening 26, by manually pressing cover 10 against the front surface of fireplace 12. Manual pressure applied by a user against cover 10 when cover 10 is positioned over opening 26 forces a sealing face of cover 10 against the front surface of fireplace 12 around opening 26 and aids in sealing the sealing face of cover 10 to the front of fireplace 12 to prevent air flow between cover 10 and the front surface of fireplace 12.

This manually applied pressure prevents a down draft from passing between the sealing face of cover 10 and the front of fireplace 12 and carrying ashes and smoke into the room. Positioning cover 10 sealingly against the front surface of fireplace 12 also forces air flow into fireplace opening 26 to pass only through air opening 14 against objects 20 to facilitate their ignition. Thus it will be understood that the dimensions of cover 10 must be at least sufficient to completely cover fireplace opening 26 and to extend outwardly beyond the dimensions of fireplace opening 26 enough to permit a user to provide with manual pressure a substantially sealing relationship between the sealing face of cover 10 and the front surface of fireplace 12 while cover 10 rests on the floor in front of fireplace opening 26.

Figure 4:
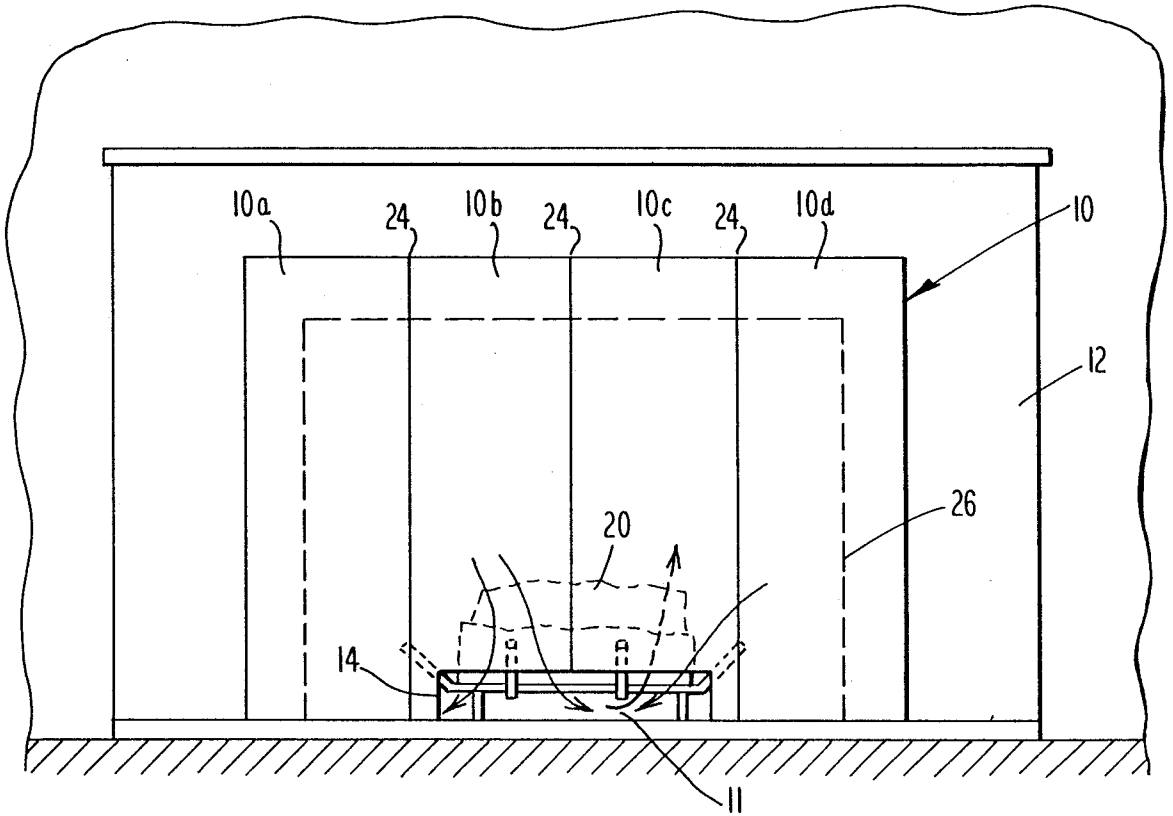
FIG. 4 shows a front view of the device of FIG. 1 completely unfolded.

In general, the temporary fireplace closure device of this invention must substantially cover the fireplace in order to prevent introduction of air except through an access opening and that access opening must be sufficiently large to permit a person to reach in and light ignition material located on the hearth or on a support such as a grate on the hearth. Moreover, the opening should not extend, that is its top should not be, above the ignition material, and preferably should extend only to about mid-height of the ignition material (i.e. less than one half the vertical distance from the hearth floor to the top of the ignition material, as shown in FIG. 4). Further, and most importantly, the opening should be generally horizontal, that is it should have a length to height ratio of at least 2, and preferably 3 (also as shown in FIG. 4) or more. The horizontal dimension or width of the opening of course should not extend horizontally substantially outward from the ignition material, i.e., its lateral limits should be roughly coincident with that of (or slightly outboard of, as shown in FIG. 4) the ignition material itself.

Figure 3:
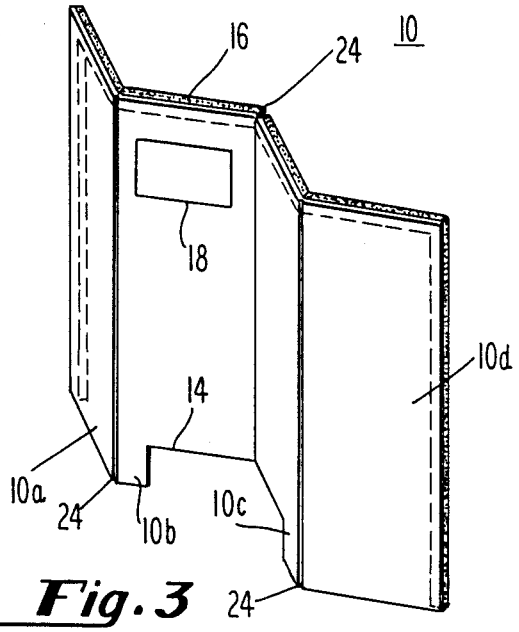
FIG. 3 shows an alternate embodiment of the device of FIG. 1 in a partially folded position.

In an alternate embodiment of cover 10 shown in FIG. 3, cover 10 is provided with foam strips 16 along the top and side edges of the sealing face of cover 10. Thus foam strips 16 press against fireplace 12 when cover 10 is in use. Foam strips 16 tend to conform to irregularities in the front surface of fireplace 12 when cover 10 is pressed against fireplace 12 and fill in spaces caused by these irregularities and prevent air flow through such spaces.

When a fire is lit within fireplace 12, cover 10 is removed from opening 26 of fireplace 12. Cover 10 is specifically configured and included means which facilitate or by which it is adapted to be easily removed. It is therefore a temporary cover and is adapted to be lightweight and easy to position over fireplace opening 26 and easy to remove from opening 26 when a fire is lit. Therefore, cover 10 may be formed of corrugated cardboard or other lightweight material treated with an appropriate flame retarding substance.

In order to make cover 10 easy and unobtrusive to store when not in use, cover 10 may be formed of panels 10*a,b,c,d* which are connected by hinges 24. Thus cover 10 may be folded into a width of one quarter of its unfolded width. Although cover 10 is shown with four panels, it will be understood that fewer panels or more panels may be provided as long as the dimensions of cover 10 when unfolded are long enough to cover fireplace opening 26. Hinges 24 may be formed, for example, by partially cutting through the corregated paper of cover 10 along the lines where hinges 24 are to be formed. The cuts should be deep enough to permit folding while not enough to separate panels 10*a,b,c,d* from each other. The portions of cover 10 which are visible when cover 10 is folded may be provided with decorative surfaces to make cover 10 more attractive when stored.

Cover 10 may also be provided with a viewing pane 18 to allow a user to view the interior of the fireplace 12 to see when a fire is lit and to determine when a good up draft has developed. This is more convenient than listening for the up draft or viewing the interior of fireplace 12 by moving the top of cover 10 away from fireplace 12. It is preferred that viewing pane 18 be provided within panel 10*b* or panel 10*c* and disposed somewhere in the top three quarters of panels 10*b*,10*c* in order to provide the best view of the interior of fireplace 12. The material of viewing pane 18 should be transparent and non-flammable. For example viewing pane 18 may be formed of glass.

While this invention has been described with reference to specific, and particularly preferred, embodiments thereof, it is not limited thereto and the appended claims are intended to be construed to encompass not only the specific forms and variants of the invention shown but to such other forms and variants as may be devised by those skilled in the art without departing from the true spirit and scope of this invention.

I claim:

1. A temporary fireplace closure for igniting ignition material disposed in a hearth region of a fireplace having a fireplace opening, comprising a cover made of a fire-resistant material, said cover substantially blocking flow of air into and out of the fireplace opening and for directing airflow into the hearth region, except in an unobstructed opening located near the bottom center portion of said closure, said opening being sufficiently large to permit access for lighting and manipulating the ignition material located in the fireplace, said opening extending vertically no higher than the ignition material and having a horizontal length to vertical height ratio of at least two, said closure also being easily and completely removable after a fire has been lit.

2. A temporary fireplace closure of claim 1 wherein said closure is rigid and adapted to be sealingly held against said fireplace over said fireplace opening.

3. A temporary fireplace closure of claim 2 wherein a portion of a sealing face of said closure held is provided with foam sealing means for preventing air flow between said sealing face portion and said fireplace.

4. A temporary fireplace closure of claim 1 wherein said closure is provided with transparent viewing means for viewing into said fireplace opening when said cover is positioned over said fireplace opening.

5. A temporary fireplace closure of claim 1 wherein said fireplace closure comprises a plurality of panels hingedly connected to each other by hinges for folding said closure along said hinges.

6. A temporary fireplace closure of claim 1 wherein said opening has a length to height ratio of 3.

7. A temporary fireplace closure of claim 1 wherein said opening has a length to height ratio of at least 3.

8. A temporary fireplace closure of claim 1 wherein the top of said opening is no higher than the midpoint of the vertical distance from the hearth floor to the top of the ignition material and the width of said opening corresponds to that of said ignition material.

9. A temporary fireplace closure of claim 1 wherein said fire-resistant material is corrugated cardboard treated with a flame retarding substance.

* * * * *